US007971628B2

(12) United States Patent
Lee et al.

(10) Patent No.: US 7,971,628 B2
(45) Date of Patent: Jul. 5, 2011

(54) METHOD AND APPARATUS FOR DIE CASTING OF PARTS

(75) Inventors: Goonhee Lee, Seonggok-Dongm Ansan-Si (KR); Bonggee Lee, Seonggok-Dongm Ansan-Si (KR)

(73) Assignee: Interplex NAS, Inc., College Point, NY (US)

( * ) Notice: Subject to any disclaimer, the term of this patent is extended or adjusted under 35 U.S.C. 154(b) by 526 days.

(21) Appl. No.: 12/170,183

(22) Filed: Jul. 9, 2008

(65) Prior Publication Data

US 2009/0017324 A1 Jan. 15, 2009

Related U.S. Application Data

(60) Provisional application No. 60/948,668, filed on Jul. 9, 2007.

(51) Int. Cl.
*B22D 17/08* (2006.01)

(52) U.S. Cl. ..... 164/113; 164/312

(58) Field of Classification Search ..... 164/113, 164/312

See application file for complete search history.

(56) References Cited

U.S. PATENT DOCUMENTS

| | | | | |
|---|---|---|---|---|
| 2,932,865 | A * | 4/1960 | Bauer | 164/113 |
| 4,049,040 | A | 9/1977 | Lynch | |
| 4,505,317 | A | 3/1985 | Prince | |
| 5,697,422 | A * | 12/1997 | Righi et al. | 164/120 |
| 7,025,114 | B2 | 4/2006 | Nagasaka et al. | |
| 7,165,598 | B2 | 1/2007 | DasGupta | |
| 2003/0041995 | A1 * | 3/2003 | Nagasaka et al. | 164/113 |
| 2004/0200595 | A1 | 10/2004 | Shirley et al. | |
| 2005/0072550 | A1 | 4/2005 | Nagasaka et al. | |

* cited by examiner

*Primary Examiner* — Kevin P Kerns

(74) *Attorney, Agent, or Firm* — Weingarten, Schurgin, Gagnebin & Lebovici LLP

(57) ABSTRACT

A cold-chamber die-casting apparatus and method for making a die-cast part with an open space within the geometry of the part. The apparatus includes an injection shaft which receives molten material for casting the part. The molten material is pushed with a plunger through a gate and into a tool cavity corresponding to the part. The gate is disposed at an end of the injection shaft and adjacent the tool cavity at a position that corresponds to the open space of the part and is inside the geometry of the part.

16 Claims, 3 Drawing Sheets

METHOD AND APPARATUS FOR DIE CASTING OF PARTS

CROSS-REFERENCE TO RELATED APPLICATIONS

This application claims priority under 35 U.S.C. §119 to U.S. Provisional Application Ser. No. 60/948,668 filed Jul. 9, 2007, which is hereby incorporated by reference in its entirety.

FIELD OF THE INVENTION

The invention relates to die casting and, more specifically, relates to a method and apparatus for cold chamber die casting of relatively thin-walled parts with an open space for receiving components such as display panels or key pads within the part geometry.

BACKGROUND OF THE INVENTION

Die casting has long been known as a method of forming parts with complex geometries and/or surface ornamentation. Historically, the die casting of aluminum parts was commonplace in the automobile industry and many of the known methods have arisen from the needs of automobile manufacturers. Recently, the need to produce smaller, and more intricate, aluminum parts has arisen in the cell phone and electronics industries because such casings have excellent resistance to wear and work well to insulate internal components from the environment (heat, shocks, wetness, etc.). Aluminum parts also provide a smooth, metallic finish that allows for additional surface treatments, such as electroplating to enhance the quality and aesthetics of the parts. However, current methods of die casting aluminum parts do not adequately and consistently produce good results when being used to form smaller, more intricate parts.

Currently, the die casting of aluminum parts involves: pouring molten aluminum from a ladle into an injection shaft, plunging the molten aluminum through an external biscuit, up through a runner into the tool cavity. The tool cavity is located above the injection shaft in order to prevent the gravitational flow of molten aluminum into the tool cavity.

If the die casting machine is configured such that the injection shaft is located at the center of the tool cavity, some of the molten aluminum will flow though the force of gravity into the tool cavity prior to plunging the melt into the cavity. The resulting parts would have a poor surface finish and less dense microstructure due to the cooling of the molten aluminum which had leaked into the cavity prior to plunging the rest of the melt.

The aforementioned conventional method is shown in FIG. 3. The injection shaft is located beneath the tool cavity and the melt is plunged through a biscuit and travels upwards through a runner and then into the tool cavity. This casting method works well for larger parts, but results in a low yield when casting thin-walled parts. For such parts, as the melt travels upwards through the runner and into the tool cavity, it cools and loses both speed and pressure, thus causing flow marks and resulting in incomplete parts and parts with a poor microstructure and surface finish when forming smaller, more intricate parts. Many of these parts will either be scrapped and re-melted or will require secondary processing to make them acceptable.

U.S. Pat. No. 7,025,114, incorporated herein by reference in its entirety, also shows a similar method of die casting, but uses a three piece mold in order to obtain two-part mold structures. With reference to FIG. 3 of U.S. Pat. No. 7,025,114, a melt is poured into pouring port 343 which is then pressed upwards through a runner 33 by a plunger 341 before entering into cavity 32 via gates 312. Similarly to the aforementioned conventional method, the melt cools and loses both speed and pressure as it travels upwards through the runner and into the gates resulting in the same types of defects when casting smaller, more intricate parts. An additional problem with this method is that the melt will be cooler when it enters into the top gates than when it enters into the lower gates as it will have had to travel a greater distance, thus resulting in parts having a non-uniform density and poor microstructure. Therefore, there is a need for a method for die casting thin-walled parts with an open space within the part geometry that will result in a higher yield.

SUMMARY OF THE INVENTION

The present invention is directed to a cold-chamber die casting machine and method that utilize a gate located in an open space inside the part geometry which prevents the gravitational flow of molten material, e.g., aluminum, zinc, or magnesium, into the tool cavity and also serves as an inlet to the tool cavity. In the present die casting method, molten aluminum, or melt, is poured via a ladle into an injection shaft. Then, a plunger located inside the injection shaft presses the melt out of the injection shaft and through a gate which is located inside the tool cavity in an area corresponding to an open space of the part. The gate contains outlets near the top of the gate, which allow the melt to fill the tool cavity and thus create the part. At this point, the mold halves will open, typically by pulling back a movable mold half from a stationary mold half, and the part will be ejected, preferably by ejector pins located in the outside structure of the gate. Excess material on the part will then be broken off, cut or trimmed.

By providing outlets only along the upper regions of the gate, the melt is prevented from leaking into the tool cavity prior to pressurizing the melt into the tool cavity via the plunger. The tool, or the mold halves, is preferably designed such that the gate is located in a portion of the tool cavity that corresponds with an empty space or open space of the part. For example, if a hand held device casing is being formed, the gate should be located inside the opening where an LCD, or liquid crystal display, is to be mounted. This is because no aluminum will fill that portion of the tool cavity as it corresponds to an open space of the part. This method of forming parts will result in a higher yield and parts formed thereby will require less secondary processing. Since the melt is pressed into the center of the tool cavity directly forming an internal biscuit, rather than through an external biscuit and long external runner, the fill time decreases and less excess material remains. Thus, the overall cycle time decreases and part production increases. Furthermore, tool life is extended because the melt can be injected into the tool cavity at a lower speed and pressure as it has less distance to travel before filling the tool cavity.

BRIEF DESCRIPTION OF THE FIGURES

These and other objects and features of the invention will become more apparent by referring to the drawings, in which.

DETAILED DESCRIPTION OF THE PREFERRED EMBODIMENTS

Figure 1:
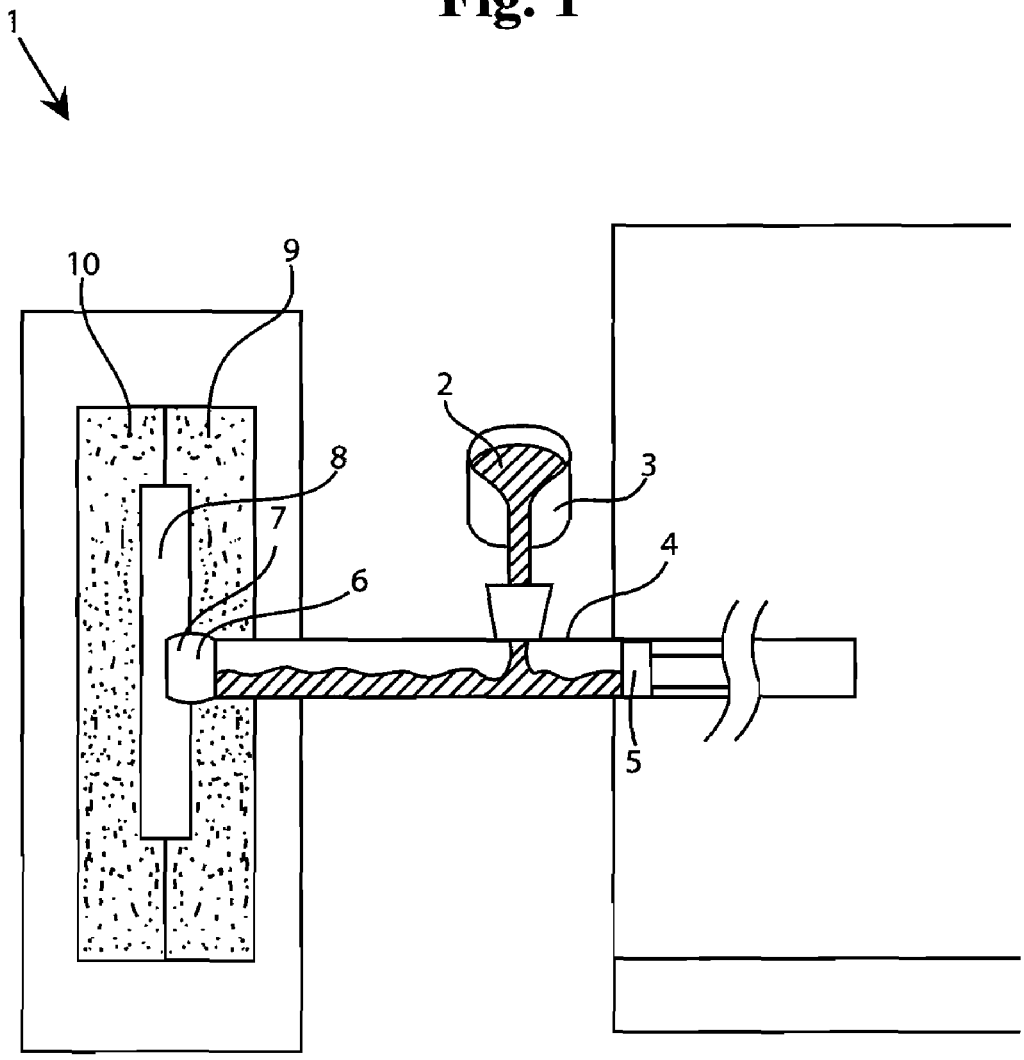
FIG. 1 is a side view of a cold-chamber die casting machine in accordance with the present invention.
Figure 2:
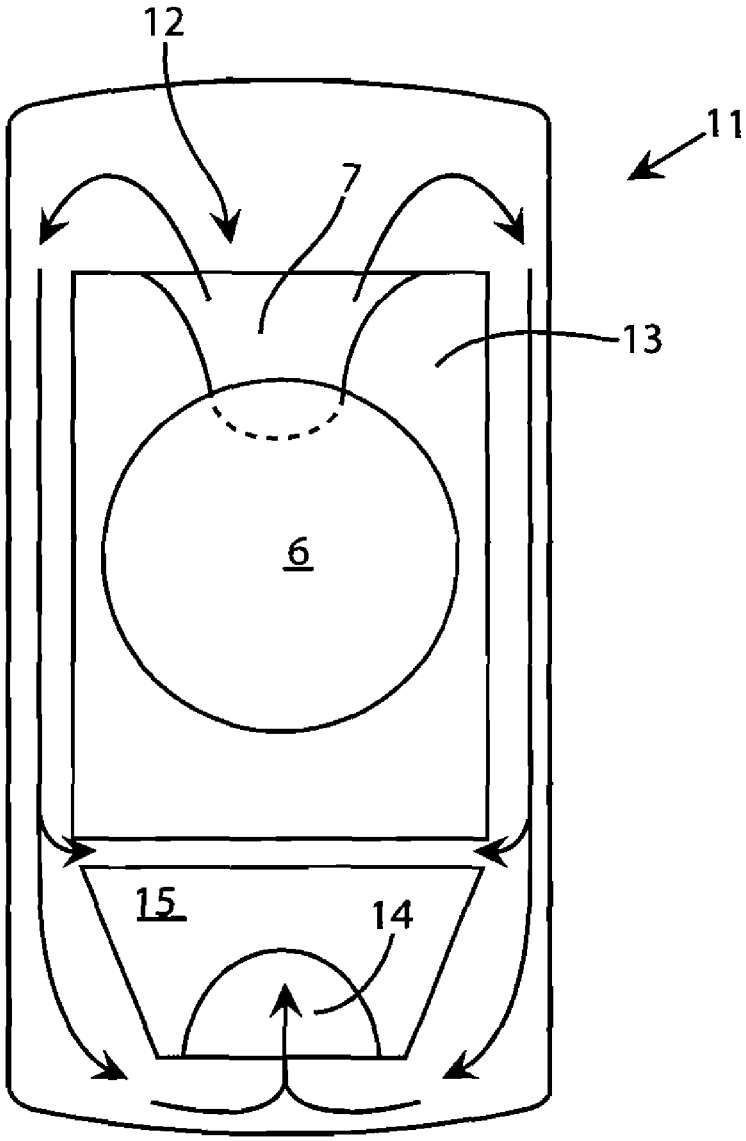
FIG. 2 is a rear view of the gate surrounded by the aluminum cast part.
Figure 3:
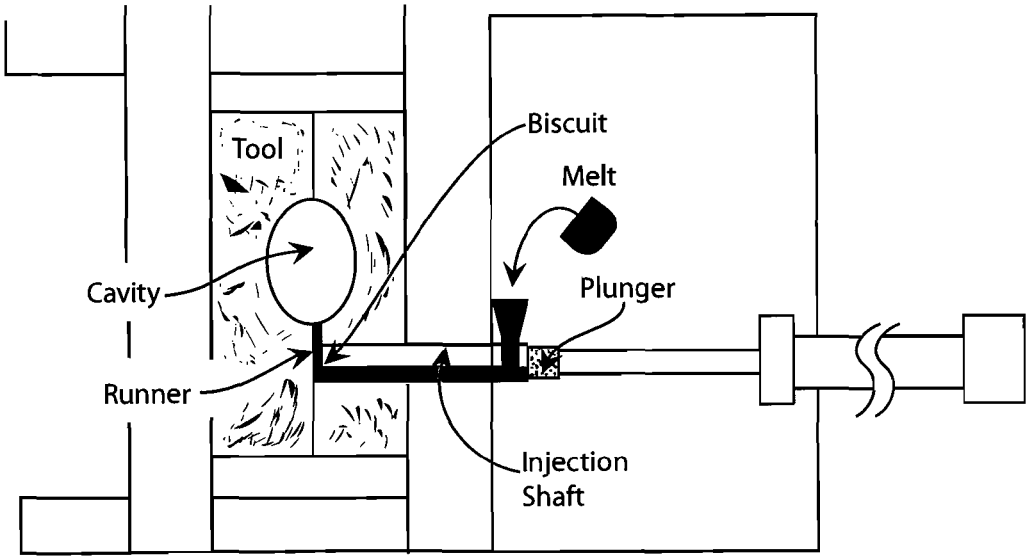
Fig.3 (Prior Art)
FIG. 3 is a side view of a conventional cold-chamber die casting machine.

FIG. 1 shows a side view of the cold-chamber die casting machine, generally at 1, according to the present invention and FIG. 2 shows a rear view of the internal biscuit 6, runner 7, and gate opening 12 or passage of the present invention connected to a finished part 11. A molten material 2, typically aluminum, is poured into an injection shaft via a ladle 3. Next, a plunger 5 pressurizes the melt or molten material 2 into the tool cavity 8 through at least one gate opening 12 located near an upper portion of the internal biscuit 6. The plunger 5 begins moving toward the tool cavity 8 first at a low speed, and then, as it gets closer to the area where an internal biscuit will be formed, it accelerates the molten material 2 at a higher speed. This is done to prevent turbulent flow of the molten material 2 which could cause flow marks, bubbles or other defects in the final part. The mold halves 9 and 10 that form the interior tool cavity 8 are clamped together by a clamping force of 85 to 200 tons to ensure that they do not separate from each other during the injection phase. For example, two suppliers of cold-chamber die casting machines, Toyo and Toshiba, produce machines that have a tool clamping force of 125 tons and 135 tones, respectively. Once the tool cavity 8 has been filled with molten material 2, the molten material 2 will cool and harden and the mold halves 9 and 10 will separate revealing a finished cast part 11. The part may be ejected through use of ejector pins located in the gate structure, preferably, near the runner 7 and/or excess overflow material 14 to minimize the number of ejector pin burrs left on the part 11.

As can be seen in FIGS. 1 and 2, the molten material 2 can only enter the tool cavity 8 through at least one gate opening 12 or passage located adjacent the runner 7 near the top of where the internal biscuit 6 is formed. Thus, prior to the plunger 5 pressurizing the molten material 2 into the tool cavity 8, no molten material 2 is able to leak into the tool cavity 8 through the force of gravity.

The molten material 2 is pressed from the injection shaft 4 into the tool cavity 8 through a gate opening 12 through the use of a plunger 5. The tip size of the plunger 5 is approximately equal in diameter to and concentric with the internal biscuit 6. The tip size of the plunger 5 is preferably smaller than those used in conventional machines so that the internal biscuit 6 is able to fit into an open space 13 of the part 11 to be molded. The open space may correspond to an electronic component, such as a display panels or key pad that is included in an electronic device using the finished molded part.

Conventional machines that utilize a clamping force between 80 and 200 tons have a plunger tip size of 45 mm or more while the plunger tip size in the present invention is preferably less than 30 mm in diameter and in a preferred embodiment is equal to 25 mm. Currently, the only machines available with a smaller tip size are those that also have a smaller clamping force. According to an embodiment of the invention, when casting smaller, more intricate parts, it is preferable to maintain a relatively high clamping force of 80 to 200 tons between the mold halves, despite decreasing the size of the plunger tip in order to ensure that the cast parts will consistently have a good surface quality.

Once the molten material 2 is pressed to the end of the injection shaft where the internal biscuit 6 will be formed after completion of injection, it is pressed upwards through the runner 7, through at least one gate opening 12, and then into the tool cavity 8 where the finished part 11 is formed therein. The gate opening 12 may be just a single aperture, a plurality of apertures or may be a tunnel or multiple tunnels from the area where the internal biscuit 6 is formed to the beginning of the part geometry. The size and shape of the gate opening 12 may vary as necessary to control the flow of molten material 2 into the part 11 in order to obtain the greatest yield for a particular part geometry.

The flow of the molten material 2 into the tool cavity 8 forming part 11 is shown in FIG. 2 through a series of flow lines. The molten material 2 exits the area where the internal biscuit 6 is formed, upwards through a runner 7 and gate opening 12, and then begins filling the tool cavity 8. In the case of the particular cavity illustrated in FIG. 2, the molten material 2, after flowing upward, will flow outward to the two sidewalls of the tool cavity 8. Subsequently, it will continue flowing downward along the two sides, and then across the bottom in an inward direction where the two flows will meet. The particular flow for a particular part will depend on the geometry of the part.

The mold halves 9 and 10 communicate to form the interior tool cavity 8 that is in the shape of part 11. It is preferable to provide some excess molten material 2 to ensure that the tool cavity 8 becomes completely filled without gaps and forms a full part 11 having a good microstructure and surface finish. Therefore, an outlet for excess overflow material 14 is provided. The size and location of the outlet for excess material overflow 14 will vary depending upon the part geometry. In a preferred embodiment, the excess material is shown entering into a second aperture 15 of part 11. After the part 11 has been ejected from the tool cavity 8, metal corresponding to the internal biscuit 6, runner 7 and gate opening 12, as well as any other excess material may be easily broken off or trimmed.

Although the preferred form of the invention has been shown and described, many features may be varied, as will readily be apparent to those skilled in this art. Thus, the foregoing description is illustrative and not limiting.

We claim:

1. A cold-chamber die-casting apparatus for casting a part having an open space within the geometry of the part, the apparatus comprising:

an injection shaft having an internal biscuit that is disposed at a distal end of the injection shaft, the internal biscuit fluidly coupled to a proximal end of a runner that delivers molten material from the injection shaft into a tool cavity via a gate opening at a distal end of the runner, the gate opening having a passage and positioned inside the geometry of the part and in the open space of the part, the injection shaft configured to receive a molten material;

a first mold half and a second mold half that interface to form a tool cavity corresponding to the part, the distal end of the injection shaft, the internal biscuit, the runner, and the gate opening confined to the first mold half; and a plunger disposed within the injection shaft and configured to inject the molten material from the injection shaft into the tool cavity through the gate opening.

2. The cold-chamber die-casting apparatus of claim 1 wherein the gate opening is in the vicinity of a center of the tool cavity.

3. The cold-chamber die-casting apparatus of claim 1 wherein the passage is at a top of the gate opening.

4. The cold-chamber die casting apparatus of claim 3, wherein a position of the passage corresponds to a top of the injection shaft.

5. The cold-chamber die casting apparatus of claim 1 wherein the first mold half is movable and the second mold half is stationary.

6. The cold-chamber die casting apparatus of claim 1 wherein a tip size of the plunger is less than 30 mm.

7. The cold-chamber die casting apparatus of claim 1 further comprising an outlet of the tool cavity configured to provide an outlet from the tool cavity for excess molten material.

8. A method of casting a part having an open space within the geometry of the part, the method comprising:

forming a tool cavity corresponding to the part by interfacing a first mold half and a second mold half;

providing an injection shaft, having an internal biscuit that is disposed at a distal end of the injection shaft, the internal biscuit fluidly coupled to a proximal end of a runner;

positioning a gate opening, having a passage, at a distal end of the runner, inside the geometry of the part and in the open space of the part;

introducing molten material into the injection shaft; and pushing the molten material from the injection shaft through the gate opening and into the tool cavity to produce a die-cast part using a plunger.

9. The method of claim 8 wherein the gate opening is disposed in the vicinity of a center of the tool cavity.

10. The method of claim 8 further comprising pouring the molten material into the injection shaft from a ladle.

11. The method of claim 8 further comprising clamping the first mold half to the second mold half with a predetermined clamping force.

12. The method of claim 11 wherein the predetermined clamping force is between 80 and 200 tons.

13. The method of claim 12 wherein a tip size of the plunger is less than 30 mm.

14. The method of claim 8 further comprising accelerating the plunger as it is pushed through the injection shaft.

15. The method of claim 8 further comprising allowing the die-cast part to harden and ejecting the die-cast part from the tool cavity using at least one ejector pin.

16. The method of claim 8 wherein the passage of the gate opening is positioned at a top of the gate opening and wherein the molten material is pushed through the top of the gate opening.

* * * * *

UNITED STATES PATENT AND TRADEMARK OFFICE

CERTIFICATE OF CORRECTION

PATENT NO. : 7,971,628 B2
APPLICATION NO. : 12/170183
DATED : July 5, 2011
INVENTOR(S) : Goonhee Lee et al.

It is certified that error appears in the above-identified patent and that said Letters Patent is hereby corrected as shown below:

Column 3, line 17, "biscuit will" should read --biscuit 6 will--.

Signed and Sealed this
Tenth Day of July, 2012

David J. Kappos

David J. Kappos
*Director of the United States Patent and Trademark Office*